US011035377B2

(12) United States Patent
Niwa et al.

(10) Patent No.: US 11,035,377 B2
(45) Date of Patent: Jun. 15, 2021

(54) COMPRESSOR HOUSING FOR TURBOCHARGER AND METHOD FOR MANUFACTURING THE SAME

(71) Applicant: OTICS CORPORATION, Nishio (JP)

(72) Inventors: Tetsuya Niwa, Aichi (JP); Tomoyuki Isogai, Aichi (JP)

(73) Assignee: OTICS CORPORATION, Nishio (JP)

( * ) Notice: Subject to any disclaimer, the term of this patent is extended or adjusted under 35 U.S.C. 154(b) by 9 days.

(21) Appl. No.: 16/408,928

(22) Filed: May 10, 2019

(65) Prior Publication Data

US 2019/0360500 A1 Nov. 28, 2019

(30) Foreign Application Priority Data

May 23, 2018 (JP) ..... JP2018-099060

(51) Int. Cl.
*F04D 29/42* (2006.01)
*F04D 29/62* (2006.01)
(Continued)

(52) U.S. Cl.
CPC ..... *F04D 29/4233* (2013.01); *F04D 29/624* (2013.01); *F05D 2240/14* (2013.01); *F05D 2300/11* (2013.01)

(58) Field of Classification Search
CPC .... F04D 29/4233; F04D 29/424; F04D 29/44; F04D 29/4226; F04D 29/624;
(Continued)

(56) References Cited

U.S. PATENT DOCUMENTS 6,193,463 B1 * 2/2001 Adeff ..... F04D 29/023 415/196
7,001,148 B2 * 2/2006 Cardenas ..... F04D 25/04 415/196
(Continued)

FOREIGN PATENT DOCUMENTS

EP 3 015 716 A1 5/2016
EP 3 173 627 A1 5/2017
JP 2016-084790 A 5/2016

OTHER PUBLICATIONS

Oct. 18, 2019 extended Search Report issued in European Patent Application No. 19175601.4.

*Primary Examiner* — J. Todd Newton
*Assistant Examiner* — Eric J Zamora Alvarez
(74) *Attorney, Agent, or Firm* — Oliff PLC

(57) ABSTRACT

A compressor housing for a turbocharger, which is composed of a scroll piece, a shroud piece, and an outer-circumferential annular piece. The scroll piece includes a through part constituting a discharge port, a first intermediate wall surface extended from an intake-side wall surface of a scroll chamber and smoothly connected with the discharge port, and a scroll outer-circumferential part. The outer-circumferential annular piece includes an outer-circumferential annular press-fit part press fitted into the scroll outer-circumferential part, and a protruding part bent from an outer-circumference-side wall surface of the scroll chamber. The protruding part is inserted into the through part to form an inner wall surface of an intermediate part that communicates the discharge port with the scroll chamber. Then, the compressor housing is fixed to a center housing that is made of iron with high rigidity through joining parts provided at the scroll piece.

9 Claims, 8 Drawing Sheets

(51) Int. Cl.
*F04D 29/44* (2006.01)
*F04D 29/66* (2006.01)

(58) Field of Classification Search
CPC .. F04D 29/023; F04D 29/4206; F04D 29/441; F04D 29/4253; F04D 25/04; F04D 29/701; F01D 29/422; F05D 2220/40; F05D 2260/37
USPC ..... 415/203
See application file for complete search history.

(56) References Cited

U.S. PATENT DOCUMENTS

| | | | | |
|---|---|---|---|---|
| 8,419,359 | B2 * | 4/2013 | Cvjeticanin | B29C 45/14467 415/200 |
| 2010/0307151 | A1 * | 12/2010 | French | F04D 29/441 60/605.1 |
| 2013/0039750 | A1 * | 2/2013 | Osuka | F04D 29/4206 415/204 |
| 2016/0123346 | A1 | 5/2016 | Isogai et al. | |
| 2017/0151608 | A1 | 6/2017 | Isogai et al. | |

* cited by examiner

COMPRESSOR HOUSING FOR TURBOCHARGER AND METHOD FOR MANUFACTURING THE SAME

CROSS-REFERENCE TO RELATED APPLICATION

The present application claims priority under 35 U.S.C. § 119 to Japanese Application No. 2018-099060, filed on May 23, 2018, entitled "COMPRESSOR HOUSING FOR TURBOCHARGER AND METHOD FOR MANUFACTURING THE SAME". The contents of this application are incorporated herein by reference in their entirety.

BACKGROUND OF THE INVENTION

Field of the Invention

The present invention relates to a compressor housing for a turbocharger, and a method for manufacturing the same.

Description of Related Art

A turbocharger installed in an engine compartment of a vehicle or the like is configured to compress sucked air in a compressor and discharge the compressed air to an internal combustion engine. That is, an air-flow path formed within a compressor housing includes a scroll chamber into which compressed air discharged from an impeller flows. The scroll chamber is configured to direct the compressed air to a discharge port and discharge the compressed air toward the internal combustion engine from the discharge port.

PRIOR ART LITERATURE

Patent Document

Patent Document 1
JP-A-2016-084790

SUMMARY OF THE INVENTION

Engine compartments of vehicles and the like have been downsized and narrowed in recent years. Consequently, a turbocharger needs to be installed in a limited space of an engine compartment. As a result, shapes of discharge ports of compressor housings tend to be complicated. In order to deal with the complicated shapes, it is conceivable that compressor housings are molded by gravity casting or low-pressure casting. Since in these casting methods, a so-called core can be used for casting, a high degree of freedom in shaping can be ensured, which makes it possible to deal with complicated shapes. However, because of its long casting cycle, productivity is low and cost is high. Further, there is a problem in that when using, for example, a sand mold, an inner surface of a scroll rough or such is made rough, and which causes deterioration of the compressor efficiency.

On the other hand, compressor housings may be molded by die-casting. Since die casting has a shorter casting cycle than gravity casting or low-pressure casting, productivity is high and cost is low. However, die-casting can be applied only to a shape that can be die-cut from a mold (a shape without undercut). Thus, shaping freedom is low and complicated shapes cannot be dealt with. To solve the problem, a compressor housing including three pieces i.e., a scroll piece, a shroud piece, and a seal plate that are assembled together is disclosed in Patent Document 1. In this disclosure, each piece is shaped to be easily die-cast, and also a scroll chamber of the compressor housing can ensure the shaping freedom.

Further, in a configuration disclosed in Patent Document 1, the scroll piece includes a through part extending through the scroll piece in an axial direction, and an intake-side end of the through part constitutes a discharge port. A first intermediate wall surface extended from an intake-side wall surface that forms the scroll chamber, being bent toward an intake side in the axial direction, is smoothly connected with the discharge port. Meanwhile, a protruding part protruding in the axial direction is formed in the seal plate so as to be inserted into the through part of the scroll piece. The protruding part has a wall surface that is opposite an inner-side wall surface of the through part. The wall surface and the inner-side wall surface form an inner wall surface of an intermediate part through which the discharge port communicates with the scroll chamber. Consequently, the scroll piece having the discharge port formed therein, and the seal plate can be shaped to have no undercut and to be releasable from a mold. Therefore, there is no need to separately prepare a die for the scroll chamber and a die for the discharge port for die-casting, so that manufacturing cost can be reduced.

In the configuration disclosed in Patent Document 1, however, the seal plate made of aluminum die-cast constitutes a portion that corresponds to a compressor-side flange of a center housing. Therefore, the seal plate is less rigid than a flange that is integrally formed with a center housing made of cast iron. Therefore, noise tends to be generated by influence of vibration of a rotating body that includes an impeller, a rotor shaft, and the like. If increasing a thickness of the seal plate to improve its rigidity, it will be necessary to increase a length of the rotor shaft accordingly, thereby increasing the whole length of the rotating body. As a result, an increased mass of the rotating body lowers natural frequency, which causes an adverse effect in respect of vibration. Further, the increase of the length of the rotating body cause increase of material cost and thereby causing an adverse effect also in respect of manufacturing cost.

Further, in the configuration disclosed in Patent Document 1, the seal plate is fastened to the center housing at a position that is relatively close to a shaft center of the rotating body. Therefore, a sufficiently high fastening rigidity is difficult to obtain, and thus noise tends to be generated by influence of vibration of the rotating body.

The present invention has been made in view of such backgrounds to provide a compressor housing for a turbocharger that reduces noise generation and prevents an increase in manufacturing cost.

One aspect of the present invention provides a compressor housing for a turbocharger, which is configured to accommodate an impeller and is configured to be attachable to a center housing that accommodates a bearing device, the compressor housing including:

an intake port configured to suck air toward the impeller;

a scroll chamber formed in a circumferential direction on an outer-circumference side of the impeller, and configured to allow air discharged from the impeller to circulate;

a discharge port configured to discharge air circulating through the scroll chamber to an outside; and an intermediate part through which the discharge port communicates with the scroll chamber, wherein the compressor housing is composed of a scroll piece, a shroud piece, and an outer-circumferential annular piece that are dividedly formed and assembled in an axial direction, wherein the scroll piece includes:

the intake port formed through the scroll piece in the axial direction;

an intake-side wall surface formed on an outer-circumference side of the intake port, the intake-side wall surface constituting a wall surface of the scroll chamber on an intake side;

a through part formed through the scroll piece in the axial direction, an intake-side end of the through part constituting the discharge port;

a first intermediate wall surface extended from the intake-side wall surface, being bent toward the intake side to be parallel to the axial direction, and smoothly connected with the discharge port, the first intermediate wall surface constituting part of an inner wall surface of the intermediate part;

a scroll outer-circumferential part that covers an outer-circumference side of the scroll chamber; and a joining part provided at the scroll outer-circumferential part to be joined to the center housing, the shroud piece includes:

a shroud press-fit part of a cylindrical shape press-fitted into the intake port;

an inner-circumference-side wall surface constituting a wall surface of the scroll chamber on the inner-circumference side;

a shroud surface opposed to the impeller; and a diffuser surface extended from the shroud surface to the scroll chamber, the outer-circumferential annular piece includes:

an outer-circumferential annular press-fit part press-fitted into the scroll outer-circumferential part;

an outer-circumference-side wall surface constituting a wall surface of the scroll chamber on the outer-circumference side; and a protruding part formed protruding toward the intake side and inserted into the through part in the axial direction, and wherein the protruding part includes a second intermediate wall surface extended from the outer-circumference-side wall surface, being bent toward the intake side to be parallel to the axial direction, the second intermediate wall surface constituting part of the inner wall surface of the intermediate part, opposing to the first intermediate wall surface.

In the compressor housing for a turbocharger, the scroll piece, the shroud piece, and the outer-circumferential annular piece are assembled in the axial direction. The scroll piece includes the through part formed through the scroll piece in the axial direction, and the intake-side end of the through part constitutes the discharge port.

The first intermediate wall surface extended from the intake-side wall surface that forms the scroll chamber, being bent toward the intake side in the axial direction, is smoothly connected with the discharge port. Further, the protruding part is inserted into the through part. The protruding part is formed in the outer-circumferential annular piece, protruding in the axial direction that corresponds to an assembly direction. The protruding part includes the second intermediate wall surface opposing to the first intermediate wall surface. The first intermediate wall surface and the second intermediate wall surface form the inner wall surface of the intermediate part through which the discharge port is communicated with the scroll chamber.

Consequently, the scroll piece having the discharge port formed therein, and the outer-circumferential annular piece each can be shaped to be releasable from a mold in an insertion direction, that is, the axial direction (shaped to have no undercut). Therefore, the scroll piece can be molded by die-casting instead of gravity casting or low-pressure casting, and thus manufacturing cost can be reduced. Further, there is no need to separately prepare a die for the scroll chamber and a die for the discharge port for die-casting, so that manufacturing cost can be reduced.

Further, the scroll outer-circumferential part includes the joining part(s) to be joined to the center housing. The joining part and a compressor-side flange of the center housing, between which the outer-circumferential annular piece is interposed, are joined to each other, so that the compressor housing is fixed to the center housing. According to such a configuration, the scroll piece is joined to the center housing that is made of iron and is more rigid than conventional aluminum seal plates. Therefore, the thickness of a joint region between the scroll piece and the center housing does not need to be increased. As a result, high rigidity is secured without increasing the length of a rotating body, and thus noise due to vibration of the rotating body is reduced. Since a length of the rotating body does not need to be increased, an increase in material cost is restricted, and thus an increase in manufacturing cost is prevented.

As described above, the present invention provides a compressor housing for a turbocharger that reduces noise generation, and prevents an increase in manufacturing cost.

DETAILED DESCRIPTION OF PREFERRED EMBODIMENTS

Figure 1:
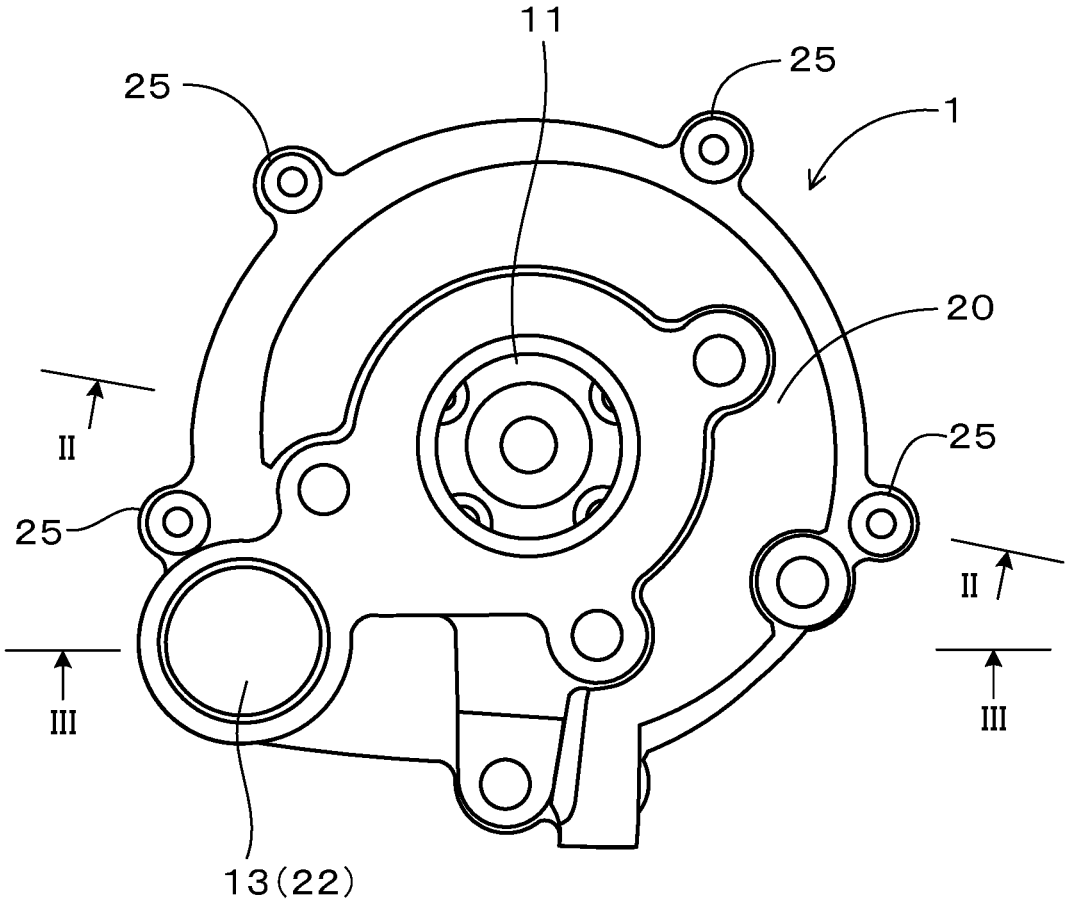
FIG. 1 is a top view of a compressor housing according to Embodiment 1.

In the above compressor housing for a turbocharger, the "circumferential direction" means a rotation direction of the impeller, and the "axial direction" means a direction of a rotating shaft of the impeller. The "intake side" means an opening side of the intake port, and a compressor-housing side in the axial direction of a rotor shaft serving as a rotating shaft of the impeller accommodated in the compressor housing. The center housing that pivotally supports the rotor shaft is located on a "side opposite to the intake side".

The first intermediate wall surface and the second intermediate wall surface each have a semicircular cross section perpendicular to a flow-path direction in the intermediate part, and are opposed to each other to form the inner wall surface of the intermediate part that has a circular cross section perpendicular to the flow-path direction. Consequently, the intermediate part has a substantially circular cross section in the axial direction, and extends in the axial direction.

Another aspect of the present invention provides a method for manufacturing the compressor housing for a turbocharger according to claim 1, the method including:

forming the scroll piece and an integral piece by die-casting, the integral piece integrally including a portion that is to be the shroud piece and a portion that is to be the outer-circumferential annular piece;

press-fitting the shroud press-fit part that constitutes part of the integral piece into the intake port of the scroll piece, and press-fitting the outer-circumferential annular press-fit part that constitutes part of the integral piece into the scroll outer-circumferential part of the scroll piece; and after the press-fitting steps, cutting the integral piece to separate into the shroud piece and the outer-circumferential annular piece.

According to the method for manufacturing the compressor housing for a turbocharger, in the forming step, two pieces, i.e., the scroll piece, and the integral piece integrally including a portion that is to be the shroud piece and a portion that is to be the outer-circumferential annular piece are formed by die-casting. Therefore, productivity can be improved while suppressing the cost for die-casting as compared with a case where three pieces of the scroll piece, the shroud piece, and the outer-circumferential annular piece are separately molded by die-casting.

In the press-fitting step, a shrink range between the scroll outer-circumferential part of the scroll piece and the outer-circumferential annular press-fit part that constitutes part of the integral piece is set smaller than a shrink range between the intake port of the scroll piece and the shroud press-fit part that constitutes part of the integral piece. In this case, the integral piece is easily press-fitted into the scroll piece.

In the press-fitting steps, the a shrink range between the scroll outer-circumferential part of the scroll piece and the outer-circumferential annular press-fit part that constitutes part of the integral piece is set to an extent to allow the outer-circumferential annular piece to be removed after the cutting step, and the method further comprises:

after the cutting step, detaching the outer-circumferential annular piece and removing cutting oil from the scroll piece and the outer-circumferential annular piece; and after the detaching and removing step, press-fitting again the outer-circumferential annular piece into the scroll piece with a seal member interposed between the scroll piece and the outer-circumferential annular piece. In this case, sealability between the scroll piece and the outer-circumferential annular piece can be enhanced.

Embodiment

Embodiment 1

An embodiment of a compressor housing 1 for a turbocharger will be described referring to FIGS. 1 to 6.

Figure 2:
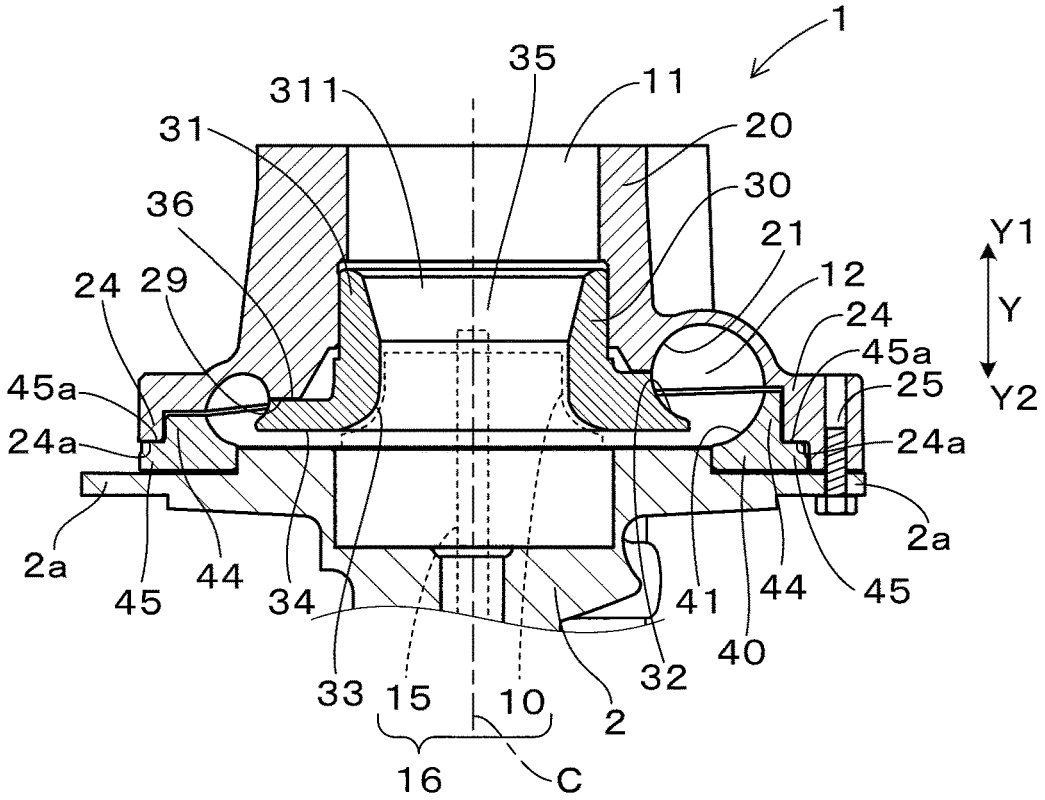
FIG. 2 is a cross-sectional view taken along line II-II in FIG. 1.
Figure 3:
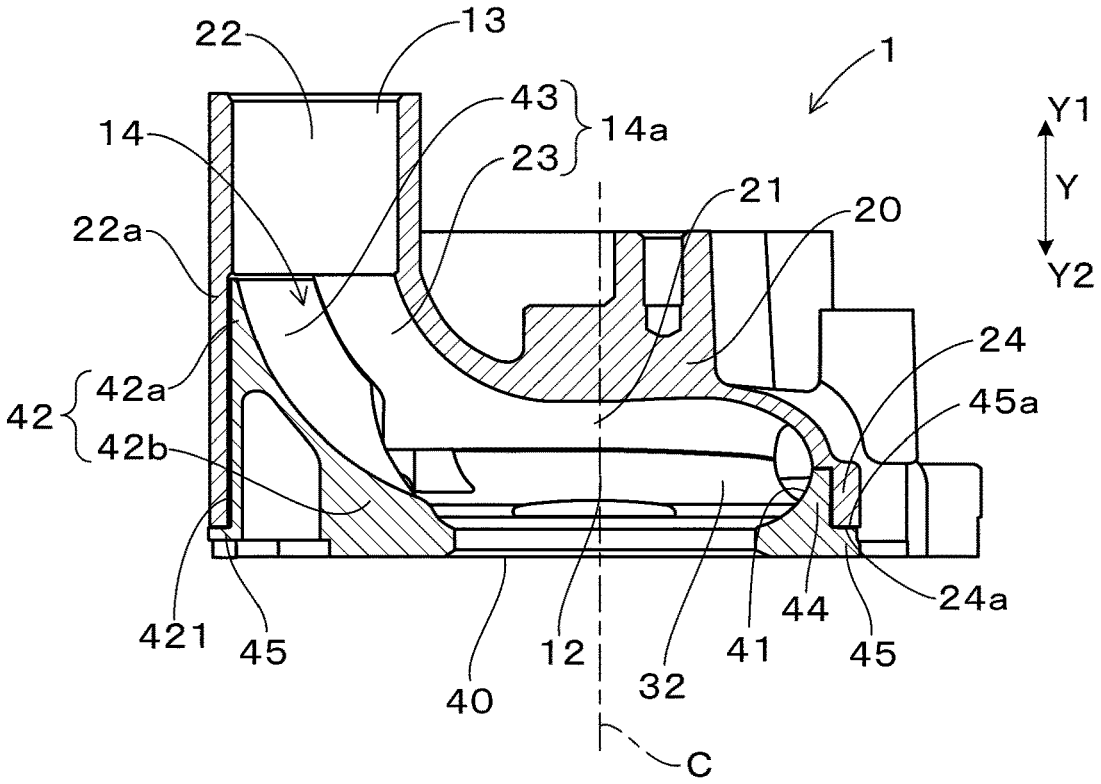
FIG. 3 is a cross-sectional view taken along line III-III in FIG. 1.

The compressor housing 1 for a turbocharger is configured to accommodate an impeller 10, and includes an intake port 11, a scroll chamber 12, and a discharge port 13, as illustrated in FIGS. 1 and 2, and includes an intermediate part 14, as illustrated in FIG. 3. As illustrated in FIG. 2, the compressor housing 1 for a turbocharger is configured to be attachable to a center housing 2 that accommodates a bearing device not illustrated.

As illustrated in FIG. 2, the intake port 11 sucks air toward the impeller 10.

The scroll chamber 12 is formed in the circumferential direction on an outer-circumference side of the impeller 10, and is configured to allow air discharged from the impeller 10 to circulate.

The discharge port 13 is configured to discharge air circulating through the scroll chamber 12 to an outside.

The intermediate part 14 allows the discharge port 13 and the scroll chamber 12 to communicate with each other, as illustrated in FIG. 3.

Figure 4:
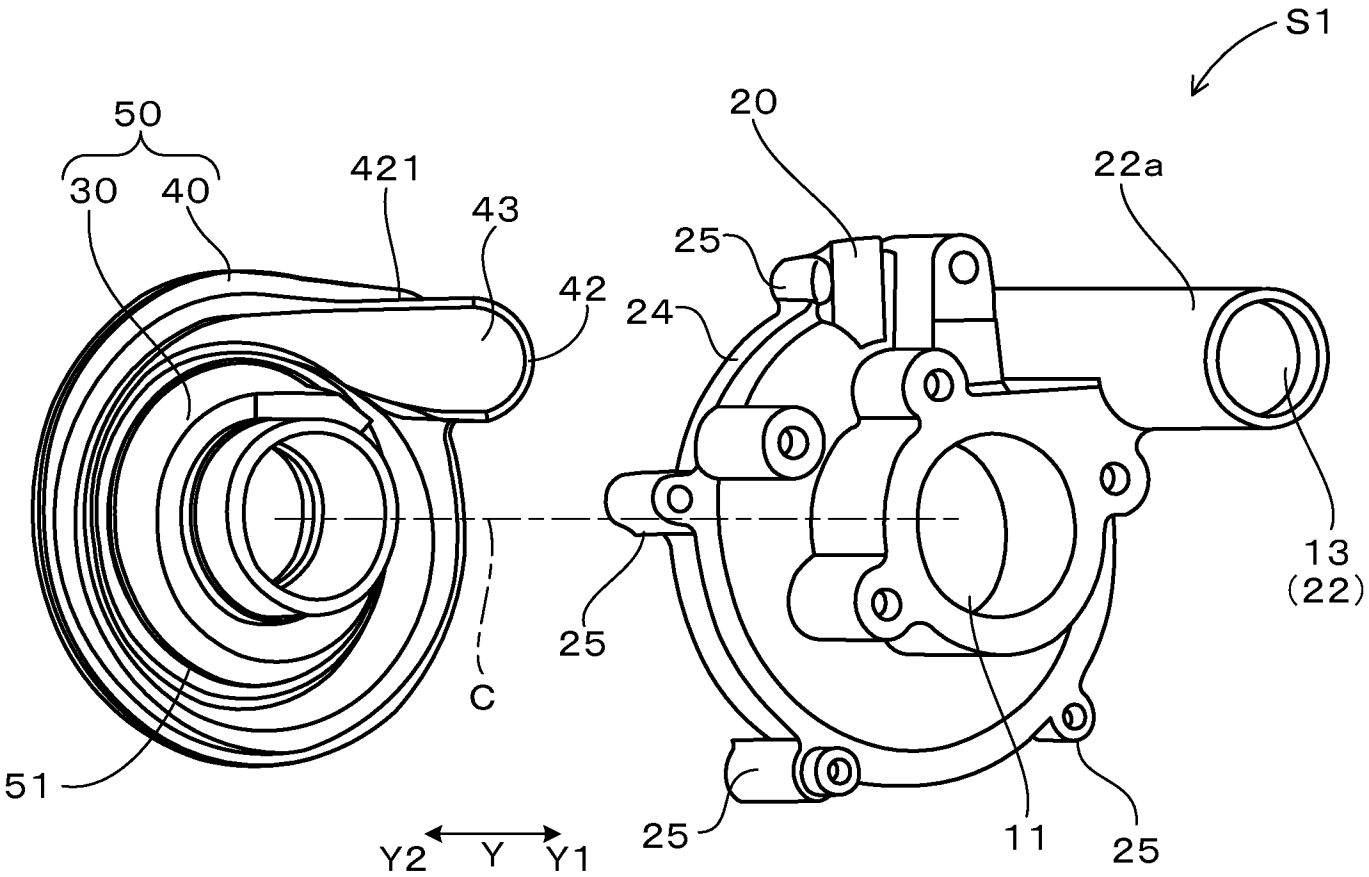
FIG. 4 is a front perspective view that illustrates a step of press-fitting according to Embodiment 1.
Figure 5:
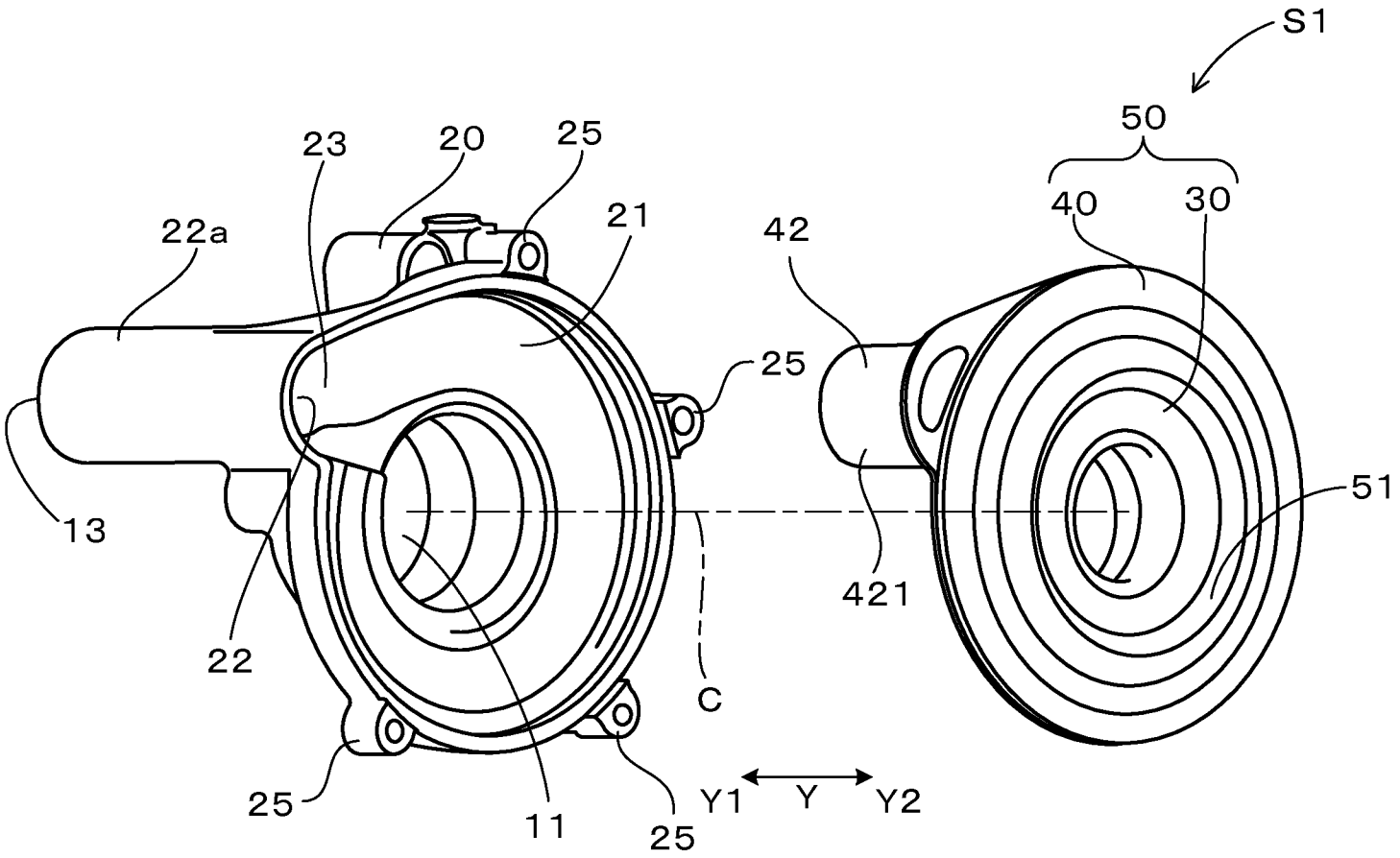
FIG. 5 is a rear perspective view that illustrates the step of press-fitting according to Embodiment 1.

As illustrated in FIGS. 4 and 5, the compressor housing 1 is composed of a scroll piece 20, a shroud piece 30, and an outer-circumferential annular piece 40 that are dividedly formed and assembled in an axial direction Y.

As illustrated in FIGS. 1 to 3, the scroll piece 20 includes the intake port 11, an intake-side wall surface 21, a through part 22, a first intermediate wall surface 23, a scroll outer-circumferential part 24, and joining parts 25. The intake port 11 is formed through the scroll piece 20 in the axial direction Y. The intake-side wall surface 21 constitutes a wall surface of the scroll chamber 12 on an intake side Y1. The through part 22 is formed through the scroll piece 20 in the axial direction Y, and has an end on the intake side Y1, which constitutes the discharge port 13. The first intermediate wall surface 23 is extended from the intake-side wall surface 21, being bent to be parallel to the axial direction Y, and is smoothly connected with the discharge port 13.

In other words, the first intermediate wall surface 23 is extended from the intake-side wall surface 21 and is bent toward the intake side Y1 in a plane parallel to the axial direction Y, and is smoothly connected with the discharge port 13, as illustrated in FIG. 3. The first intermediate wall surface 23 constitutes part of an inner wall surface 14*a* of the intermediate part 14. The scroll outer-circumferential part 24 covers an outer-circumference side of the scroll chamber 12. The joining parts 25 are provided at the scroll outer-circumferential part 24, and are directly joined to joined portions 2*a* formed at the center housing 2, as illustrated in FIG. 2. Consequently, the scroll piece 20 is directly fixed to the center housing 2. Seal members may be interposed between the joining parts 25 and the joined portions 2*a*.

As illustrated in FIG. 2, the shroud piece 30 includes a shroud press-fit part 31, an inner-circumference-side wall surface 32, a shroud surface 33, and a diffuser surface 34. The shroud press-fit part 31 is formed in a cylindrical shape, and is press-fitted into the intake port 11. The inner-circumference-side wall surface 32 constitutes a wall surface of the scroll chamber 12 on an inner-circumference side. The shroud surface 33 is opposed to the impeller 10. The diffuser surface 34 is extended from the shroud surface 33 to the scroll chamber 12.

The shroud piece 30 also has an intake path 35 formed through the shroud press-fit part 31 and communicated with the intake port 11. The shroud piece 30 also includes a facing surface 36 that is opposite the diffuser surface 34 (on the intake side Y1). The facing surface 36 faces the scroll piece 20 in the axial direction Y. Meanwhile, the scroll piece 20 includes a contact portion 29 with which the facing surface 36 of the shroud piece 30 is made to contact in the axial direction Y, as illustrated in FIG. 2. The facing surface 36 is made to contact with the contact portion 29 of the scroll piece 20 in the axial direction Y, so that the shroud piece 30 is positioned in the axial direction Y.

As illustrated in FIG. 3, the outer-circumferential annular piece 40 includes an outer-circumference-side wall surface 41, a protruding part 42, and an outer-circumferential annular press-fit part 44. The outer-circumference-side wall surface 41 constitutes a wall surface of the scroll chamber 12 on the outer-circumference side. The protruding part 42 is formed protruding toward the intake side Y1 and is inserted into the through part 22 in the axial direction Y. The protruding part 42 includes a second intermediate wall surface 43 that is opposed to the first intermediate wall surface 23 and constitutes part of the inner wall surface 14*a* of the intermediate part 14. The second intermediate wall surface 43 is extended from the outer-circumference-side wall surface 41, being bent toward the intake side Y1 to be parallel to the axial direction Y. In other words, as illustrated in FIG. 3, the second intermediate wall surface 43 is extended from the outer-circumference-side wall surface 41 and is bent toward the intake side Y1 in a plane parallel to the axial direction Y.

The outer-circumferential annular press-fit part 44 is press-fitted into the scroll outer-circumferential part 24 of the scroll piece 20. In the present embodiment, the outer-circumferential annular press-fit part 44 forms an outer-circumferential portion of the outer-circumferential annular piece 40, and includes a flange 45 at an outer edge of the outer-circumferential annular press-fit part 44, the flange 45 protruding in an outer-circumference direction of the outer-circumferential annular press-fit part 44. A surface of the flange 45 on the intake side Y1 constitutes a seal surface 45*a* in contact with an outer-circumferential end surface 24*a* that is an end surface of the scroll outer-circumferential part 24 on a side Y2 opposite to the intake side Y1. The outer-circumferential end surface 24*a* and the seal surface 45*a* are parallel to each other.

The scroll piece 20, the shroud piece 30, and the outer-circumferential annular piece 40 are formed so as to withstand circulation of compressed air. As illustrated in FIG. 2, a rotor shaft 15 is pivotally supported in a rotatable way by the bearing device (not illustrated) accommodated in the center housing 2. The rotor shaft 15 to which the impeller 10 is attached constitutes a rotating body 16 together with a rotor (not illustrated).

Figure 6:
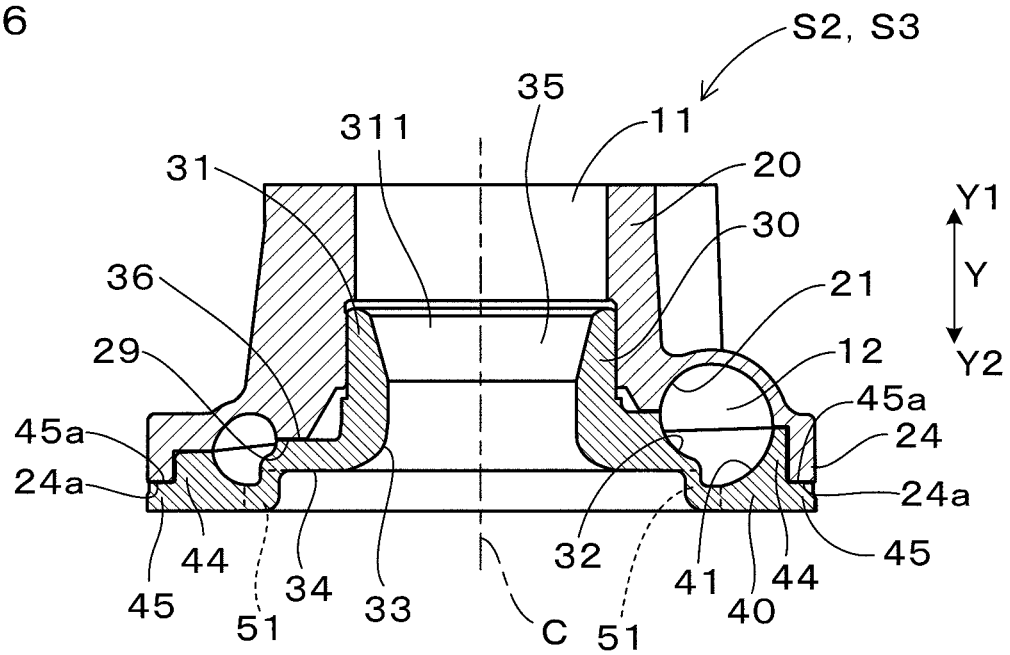
FIG. 6 is a cross-sectional view taken along line II-II in FIG. 1 that illustrates the step of press-fitting.
Figure 7:
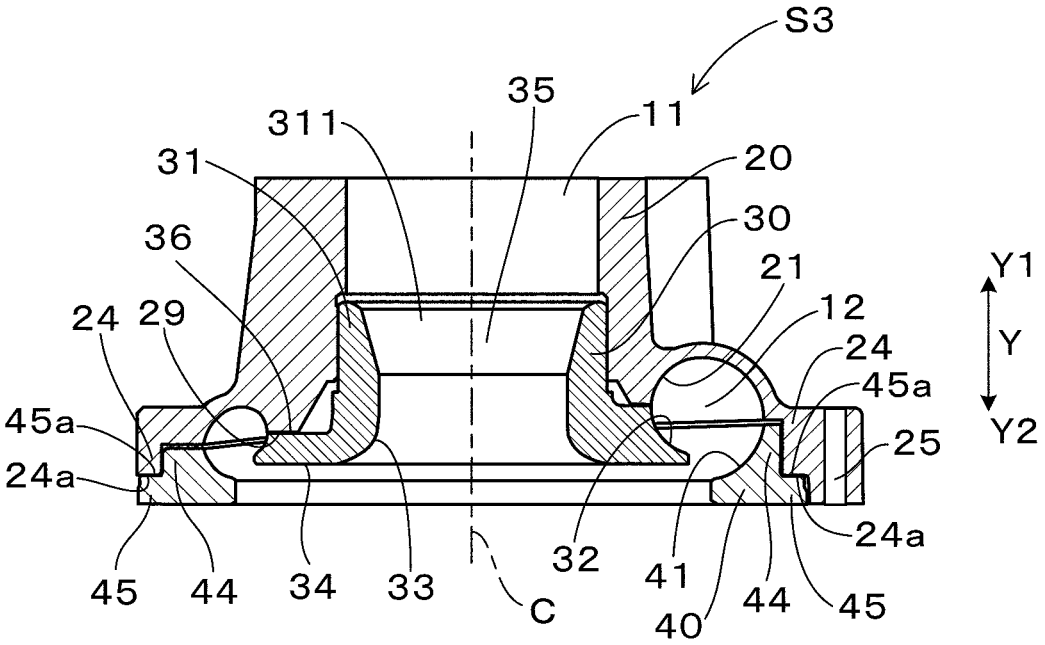
FIG. 7 is a cross-sectional view taken along line II-II in FIG. 1 that illustrates a step of cutting.

A method for manufacturing the compressor housing 1 according to the present embodiment includes a step S1 of forming the scroll piece 20 illustrated in FIGS. 4 and 5, and an integral piece 50 by die-casting, the integral piece 50 integrally including a portion that is to be the shroud piece 30 and a portion that is to be the outer-circumferential annular piece 40; a step S2 of press-fitting the shroud press-fit part 31 that constitutes part of the integral piece 50 illustrated in FIG. 6 into the intake port 11 of the scroll piece 20 and press-fitting the outer-circumferential annular press-fit part 44 that constitutes part of the integral piece 50 into the scroll outer-circumferential part 24 of the scroll piece 20; and after the press-fitting step S2, a step S3 of cutting the integral piece 50 illustrated in FIGS. 6 and 7 to separate into the shroud piece 30 and the outer-circumferential annular piece 40.

Hereinafter, the method will be described in detail.

First, in the forming step S1, the scroll piece 20 and the integral piece 50 are molded by die-casting, as illustrated in FIGS. 4 and 5. In the present embodiment, as illustrated in FIG. 6, the portion of the integral piece 50 that is to be the shroud piece 30 and the portion of the integral piece 50 that is to be the outer-circumferential annular piece 40 are connected with each other through an annular connecting portion 51 between the inner-circumference-side wall surface 32 and the outer-circumference-side wall surface 41.

Next, in the press-fitting step S2, the integral piece 50 is press-fitted into the scroll piece 20 in the axial direction Y, as illustrated in FIG. 6. Specifically, while a phase of the discharge port 13 is aligned, as illustrated in FIG. 4, the shroud press-fit part 31 that constitutes part of the integral piece 50 is press-fitted into the intake port 11 of the scroll piece 20, and the outer-circumferential annular press-fit part 44 that constitutes part of the integral piece 50 is press-fitted into the scroll outer-circumferential part 24, as illustrated in FIG. 6. A shrink range between the scroll outer-circumferential part 24 and the outer-circumferential annular press-fit part 44 is smaller than a shrink range between the intake port 11 and the shroud press-fit part 31. In the present embodiment, the shrink range between the scroll outer-circumferential part 24 and the outer-circumferential annular press-fit part 44 is set to an extent to loosely press-fit the outer-circumferential annular press-fit part 44 into the scroll outer-circumferential part 24 to be separated from each other later.

Then, as illustrated in FIG. 6, the facing surface 36 of a portion of the integral piece 50 that is to be the shroud piece 30 is made in contact with the contact portion 29 of the scroll piece 20 in the axial direction Y so that the integral piece 50 is positioned in the axial direction Y, and the press-fitting of the integral piece 50 is completed. Consequently, the intake-side wall surface 21, the inner-circumference-side wall surface 32, and the outer-circumference-side wall surface 41 form the scroll chamber 12 in the circumferential direction outside the impeller 10.

Further, in the press-fitting step S2, the protruding part 42 is inserted into the through part 22 by press-fitting the integral piece 50. As illustrated in FIGS. 4 and 5, the through part 22 is formed by a cylindrical portion 22*a* that has a substantially cylindrical shape extending in the axial direction Y. An end of the cylindrical portion 22*a* on the intake side Y1 has a circular opening that forms the discharge port 13. The vicinity of an end of the cylindrical portion 22*a* on a Y2 side opposite the intake side Y1 is cut off on a central C side. As illustrated in FIG. 3, the through part 22 has the first intermediate wall surface 23. The first intermediate wall surface 23 is bent in a direction which shifts from an opening direction of the discharge port 13 (axial direction Y) to a formation direction in which the scroll chamber 12 is formed (circumferential direction perpendicular to the axial direction Y) so that the first intermediate wall surface 23 smoothly connects the discharge port 13 with the intake-side wall surface 21.

As illustrated in FIGS. 4 and 5, the protruding part 42 protrudes toward the intake side Y1, and has an outer circumference surface 421 parallel to the axial direction Y. As illustrated in FIG. 4, the outer circumference surface 421 has a shape that fits in an inner wall of the cylindrical portion 22*a* that forms the through part 22. The second intermediate wall surface 43 is formed on the inside of the protruding part 42. The second intermediate wall surface 43 is bent in a direction which shifts from the axial direction Y to a circumferential direction perpendicular to the axial direction Y so that an end of the second intermediate wall surface 43 on the intake side Y1 is smoothly connected with the outer-circumference-side wall surface 41.

As illustrated in FIG. 3, the protruding part 42 is inserted into the through part 22 in the interference-fitting step S2 so that the first intermediate wall surface 23 and the second intermediate wall surface 43 are opposed to each other. As a result, the inner wall surface 14*a* of the intermediate part 14 through which the scroll chamber 12 communicates with the discharge port 13 is formed. The first intermediate wall surface 23 and the second intermediate wall surface 43 each have a semicircular cross section perpendicular to a flow-path direction in the intermediate part 14. The first intermediate wall surface 23 is disposed opposite the second intermediate wall surface 43. As a result, the inner wall surface 14*a* of the intermediate part 14 is formed to have a substantially circular cross section perpendicular to the flow-path direction. Consequently, the intermediate part 14 has a tube-like shape.

Since the first intermediate wall surface 23 and the second intermediate wall surface 43 have the shapes described above, the intermediate part 14 communicates with the discharge port 13 at an end 42*a* of the intermediate part 14 on the intake side Y1, and communicates with, at a base 42*b* of the intermediate part 14 (an end on the side Y2 that is opposite the intake side Y1), the scroll chamber 12 formed in the circumferential direction, as illustrated in FIG. 3. The intermediate part 14 is bent in a direction which shifts from the opening direction of the discharge port 13 (axial direction Y) to the formation direction in which the scroll chamber 12 is formed (circumferential direction perpendicular to the axial direction Y) so that the intermediate part 14 smoothly connects the discharge port 13 and the scroll chamber 12.

A pipe (not illustrated) through which compressed air discharged from the scroll chamber 12 is supplied to an internal combustion engine is connected to the discharge port 13. A joint made of a deformable material may be interposed between the pipe and the discharge port 13.

In the cutting step S3 after the press-fitting step S2, the integral piece 50 is separated into the shroud piece 30 and the outer-circumferential annular piece 40 by cutting the connecting portion 51 of the integral piece 50 illustrated in FIG. 6, and a predetermined gap is formed between the shroud piece 30 and the outer-circumferential annular piece 40, as illustrated in FIG. 7.

Figure 8:
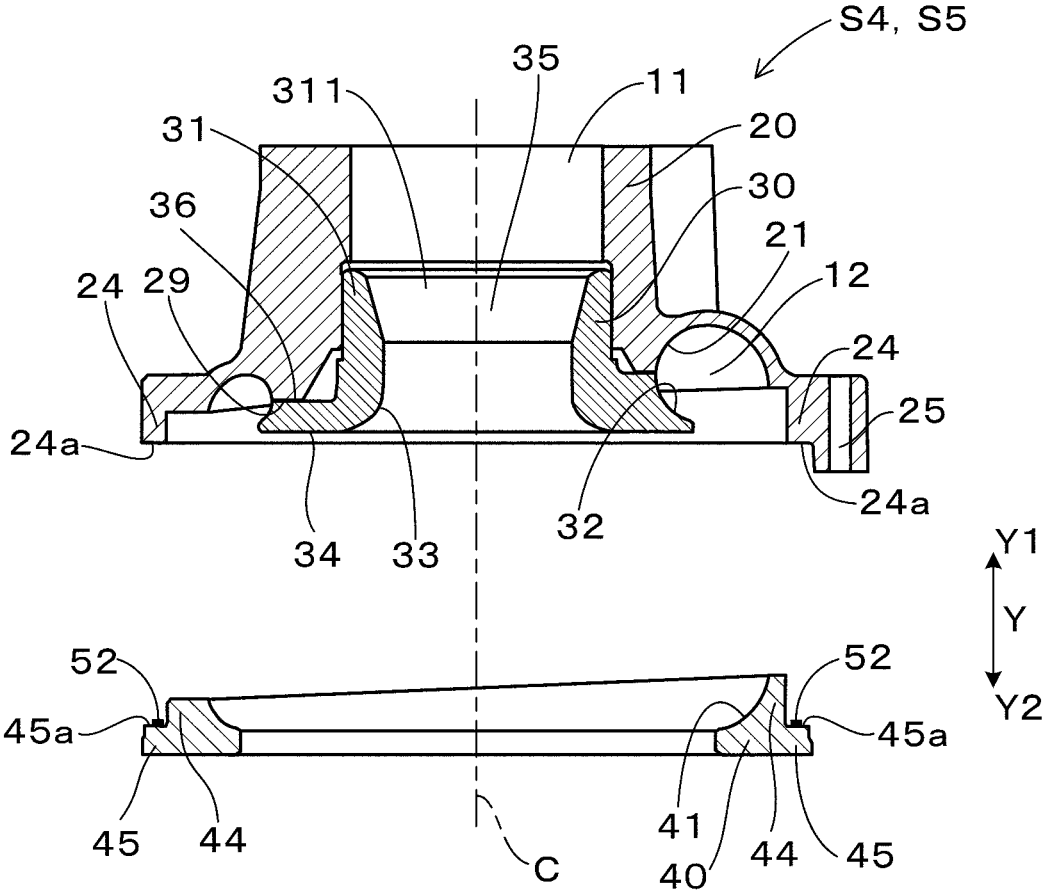
FIG. 8 is a cross-sectional view along line II-II in FIG. 1 that illustrates a step of detaching.
Figure 9:
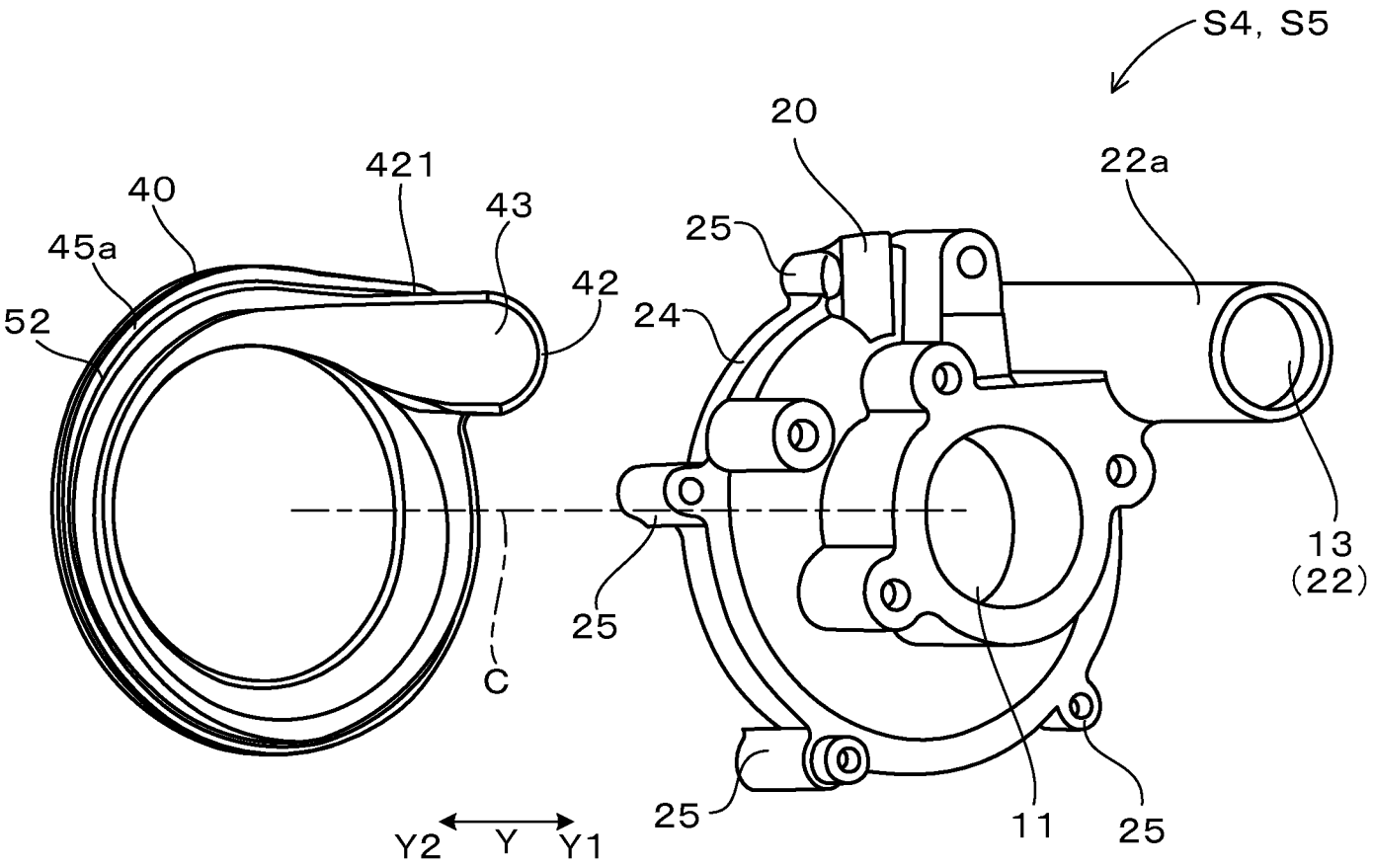
FIG. 9 is a front perspective view that illustrates a step of press-fitting again according to Embodiment 1.
Figure 10:
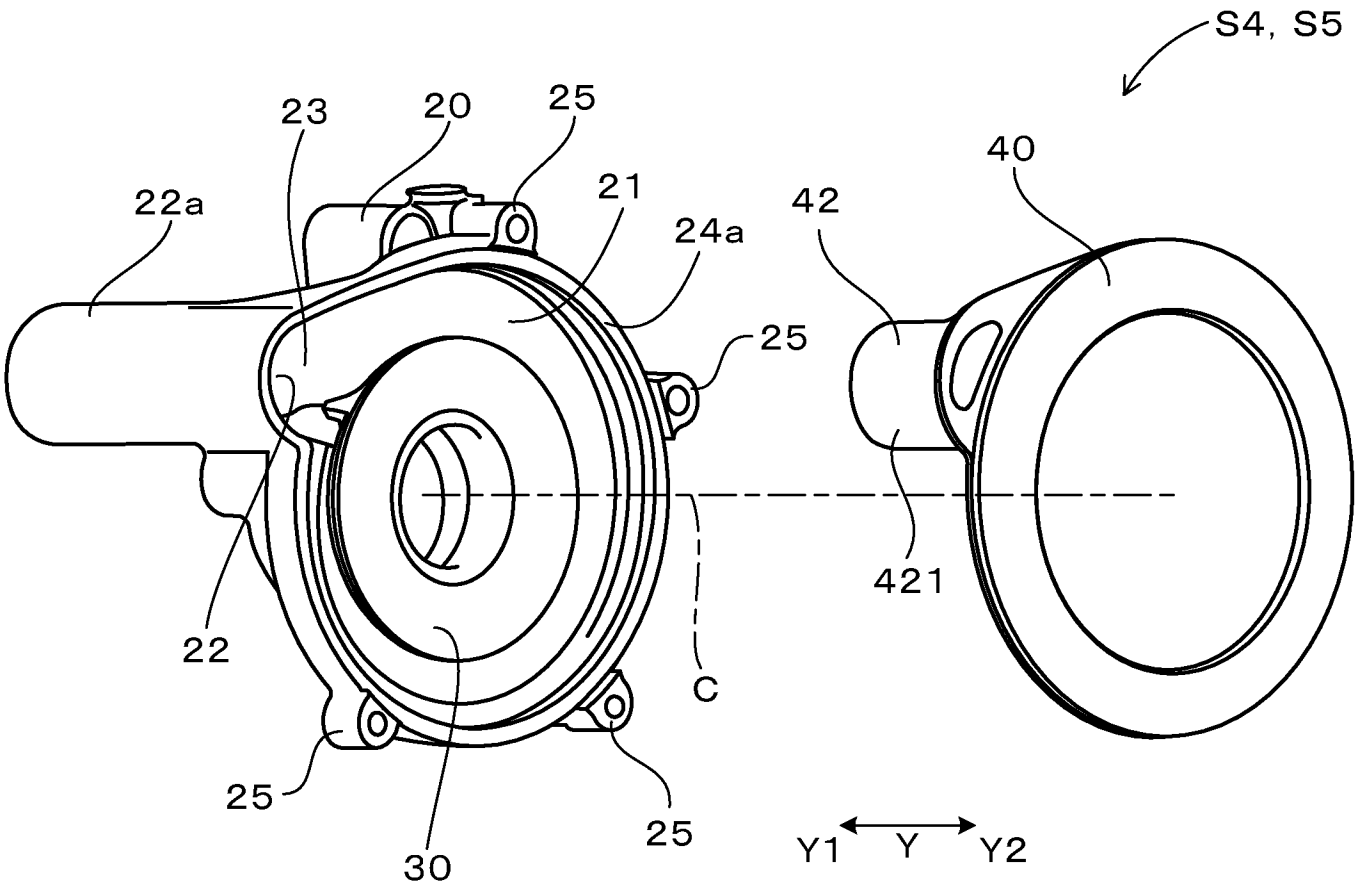
FIG. 10 is a rear perspective view that illustrates the step of press-fitting according to Embodiment 1.

In the present embodiment, as illustrated in FIGS. 8, 9, and 10, after the cutting step S3, a step S4 of detaching the outer-circumferential annular piece 40 that has been loosely press-fitted into the scroll outer-circumferential part 24, and removing cutting oil that has been left in the cutting step S3 is performed. Then, a step S5 of press-fitting the outer-circumferential annular piece 40 into the scroll outer-circumferential part 24 again with a seal member 52 interposed between the outer-circumferential end surface 24*a* that is an end surface of the scroll outer-circumferential part 24 on the side Y2 that is opposite the intake side Y1 and the seal surface 45*a* that is a surface of the flange 45 on the intake side Y1 is performed, as illustrated in FIGS. 8 and 9. In the step S5, the seal surface 45*a* is made in contact with the outer-circumferential end surface 24*a* so that the outer-circumferential annular piece 40 is positioned, and the press-fitting of the outer-circumferential annular piece 40 is completed. Consequently, the compressor housing 1 illustrated in FIGS. 1 and 2 is obtained.

Next, effect of the compressor housing 1 according to the present embodiment will be described in detail.

In the compressor housing 1 according to the present embodiment, the scroll piece 20, the shroud piece 30, and the outer-circumferential annular piece 40 are assembled in the axial direction Y. The scroll piece 20 has the through part 22 formed therethrough in the axial direction Y, and an end of the through part 22 on the intake side Y1 constitutes the discharge port 13. The first intermediate wall surface 23 extended from the intake-side wall surface 21 that forms the scroll chamber 12, being bent toward the intake-side in the axial direction Y, is smoothly connected with the discharge port 13. Further, the protruding part 42 is inserted into the through part 22. The protruding part 42 is formed protruding in the outer-circumferential annular piece 40 in the axial direction Y that corresponds to the assembly direction. The protruding part 42 includes the second intermediate wall surface 43 opposing to the first intermediate wall surface 23. The first intermediate wall surface 23 and the second intermediate wall surface 43 form the inner wall surface 14*a* of the intermediate part 14 through which the discharge port 13 is communicated with the scroll chamber 12.

Consequently, the scroll piece 20 including the discharge port 13, and the outer-circumferential annular piece 40 can be shaped to be releasable from a mold (to have no undercut) in an insertion direction, that is, the axial direction Y. Therefore, the scroll piece 20 can be molded by die-casting instead of gravity casting or low-pressure casting, and manufacturing cost can be reduced. Further, a die for the scroll chamber 12 and a die for the discharge port 13 do not need to be separately prepared for die casting, and thus manufacturing cost can be reduced. Since the number of components does not increase, and assembly is not complicated as compared with conventional techniques, manufacturing cost does not increase.

The scroll outer-circumferential part 24 of the scroll piece 20 includes the joining parts 25 to be joined to the center housing 2. The joining parts 25 and the joined portions 2*a* of the center housing 2, between which the outer-circumferential annular piece 40 is interposed, are joined to each other. As a result, the compressor housing 1 can be fixed to the center housing 2. Consequently, the scroll piece 20 is joined to the center housing 2 that is made of iron and is more rigid than conventional aluminum seal plates. Therefore, the thickness of a joint region between the scroll piece 20 and the center housing 2 does not need to be increased. As a result, high rigidity is secured without increasing the length of the rotating body 16 that includes the impeller 10 and the rotor shaft 15, and thus noise due to vibration of the rotating body 16 is reduced. Since a length of the rotating body 16 does not need to be increased, an increase in material cost is restricted, and thus an increase in manufacturing cost is prevented.

Further, in the present embodiment, the first intermediate wall surface 23 and the second intermediate wall surface 43 each have a semicircular cross section perpendicular to a flow-path direction, and are opposed to each other to form the inner wall surface 14*a* of the intermediate part 14 that has a circular cross section perpendicular to the flow-path direction. Consequently, the discharge port 13 has a substantially circular cross section perpendicular to the flow-path direction, and thus has a cylindrical shape extending in the axial direction Y. Such a configuration prevents circulation of compressed air from being interrupted in the discharge port 13.

In the present embodiment, the scroll piece 20 and the outer-circumferential annular piece 40 are made by aluminum die-casing. Since the scroll piece 20 and the outer-circumferential annular piece 40 are made of the same material, and thus have the same coefficient of thermal expansion, a gap is unlikely to be formed between seal portions (outer-circumferential end surface 24*a* and the seal surface 45*a*) of the scroll piece 20 and the outer-circumferential annular piece 40. Therefore, air tightness of the compressor housing 1 can be improved.

The method for manufacturing the compressor housing 1 for a turbocharger according to the present embodiment includes the step S1 of forming the scroll piece 20, and the integral piece 50 by die-casting, the integral piece 50 integrally including a portion that is to be the shroud piece 30 and a portion that is to be the outer-circumferential annular piece 40, the step S2 of press-fitting the shroud press-fit part 31 that constitutes part of the integral piece 50 into the intake port 11 of the scroll piece 20, and press-fitting the outer-circumferential annular press-fit part 44 that constitutes part of the integral piece 50 into the scroll outer-circumferential part 24 of the scroll piece 20, and the step S3 of, after the press-fitting step S2, cutting the integral piece 50 to separate into the shroud piece 30 and the outer-circumferential annular piece 40. Consequently, in the forming step S1, two pieces, i.e., the scroll piece 20, and the integral piece 50 integrally including a portion that is to be the shroud piece 30 and a portion that is to be the outer-circumferential annular piece 40 are formed by die-casting. Therefore, productivity can be improved while suppressing the cost for die-casting as compared with a case where three pieces of the scroll piece 20, the shroud piece 30, and the outer-circumferential annular piece 40 are separately molded by die-casting.

Further, in the press-fitting step S2 according to the present embodiment, a shrink range between the scroll outer-circumferential part 24 of the scroll piece 20 and the outer-circumferential annular press-fit part 44 that constitutes part of the integral piece 50 is smaller than a shrink range between the intake port 11 of the scroll piece 20 and the shroud press-fit part 31 that constitutes part of the integral piece 50. Consequently, the integral piece 50 is easily press-fitted into the scroll piece 20, and the outer-circumferential annular piece 40 is easily removed from the integral piece 50.

Further, in the interference-fitting step S2 according to the present embodiment, the amount of interference between the scroll outer-circumferential part 24 of the scroll piece 20 and the outer-circumferential annular press-fit part 44 that constitutes part of the integral piece 50 allows the outer-circumferential annular piece 40 to be removed after the cutting step S3. The method for manufacturing the compressor housing 1 for a turbocharger according to the present embodiment further includes the removing step S4 of, after the cutting step S3, removing the outer-circumferential annular piece 40 and removing cutting oil from the scroll piece 20 and the outer-circumferential annular piece 40, and the second interference-fitting step S5 of, after the removing step S4, interference-fitting the outer-circumferential annular piece 40 into the scroll piece 20 again with the seal member 52 interposed between the scroll piece 20 and the outer-circumferential annular piece 40. According to such a method, sealability between the scroll piece 20 and the outer-circumferential annular piece 40 can be enhanced.

As described above, the present embodiment provides the compressor housing 1 for a turbocharger that reduces noise generation, and prevents an increase in manufacturing cost.

What is claimed is:

1. A compressor housing for a turbocharger, which is configured to accommodate an impeller and is configured to be attachable to a center housing that accommodates a bearing device, the compressor housing comprising:

an intake port configured to suck air toward the impeller;

a scroll chamber formed in a circumferential direction on an outer-circumference side of the impeller, and configured to allow air discharged from the impeller to circulate;

a discharge port configured to discharge air circulating through the scroll chamber to an outside; and an intermediate part through which the discharge port communicates with the scroll chamber, wherein the compressor housing is composed of a scroll piece, a shroud piece, and an outer-circumferential annular piece that are dividedly formed and assembled in an axial direction, wherein the scroll piece includes:

the intake port formed through the scroll piece in the axial direction;

an intake-side wall surface formed on an outer-circumference side of the intake port, the intake-side wall surface constituting a wall surface of the scroll chamber on an intake side;

a through part formed through the scroll piece in the axial direction, an intake-side end of the through part constituting the discharge port;

a first intermediate wall surface extended from the intake-side wall surface, being bent toward the intake side to be parallel to the axial direction, and smoothly connected with the discharge port, the first intermediate wall surface constituting part of an inner wall surface of the intermediate part;

a scroll outer-circumferential part that covers an outer-circumference side of the scroll chamber; and a joining part provided at the scroll outer-circumferential part to be joined to the center housing, the joining part being configured to be directly joined to joined portions formed at the center housing, so as to directly fix the scroll piece to the center housing, the shroud piece includes:

a shroud-press-fit part of a cylindrical shape press-fitted into the intake port;

an inner-circumference-side wall surface constituting a wall surface of the scroll chamber on the inner-circumference side;

a shroud surface opposed to the impeller; and a diffuser surface extended from the shroud surface to the scroll chamber, the outer-circumferential annular piece includes:

an outer-circumferential annular press-fit part press-fitted into the scroll outer-circumferential part, the scroll outer-circumferential part abutting the outer-circumferential annular press-fit part along an entire innermost circumferential side of the scroll outer-circumferential part extending in the axial direction and along a bottom-most side of the scroll outer-circumferential part extending perpendicular to the entire innermost circumferential side;

an outer-circumference-side wall surface constituting a wall surface of the scroll chamber on the outer-circumference side; and a protruding part formed protruding toward the intake side and inserted into the through part in the axial direction, wherein an outer diameter surface of the center housing is mated with an inner diameter surface of the outer-circumferential annular piece, and wherein the protruding part includes a second intermediate wall surface extended from the outer-circumference-side wall surface, being bent toward the intake side to be parallel to the axial direction, the second intermediate wall surface constituting part of the inner wall surface of the intermediate part, opposing to the first intermediate wall surface.

2. The compressor housing for a turbocharger according to claim 1, wherein the first intermediate wall surface and the second intermediate wall surface each have a semicircular cross section perpendicular to a flow-path direction in the intermediate part, and are opposed to each other to form the inner wall surface of the intermediate part that has a circular cross section perpendicular to the flow-path direction.

3. A method for manufacturing the compressor housing for a turbocharger according to claim 1, the method comprising:

forming the scroll piece and an integral piece by die-casting, the integral piece integrally including a portion that is to be the shroud piece and a portion that is to be the outer-circumferential annular piece;

press-fitting the shroud press-fit part that constitutes part of the integral piece into the intake port of the scroll piece, and press-fitting the outer-circumferential annular press-fit part that constitutes part of the integral piece into the scroll outer-circumferential part of the scroll piece; and after the press-fitting steps, cutting the integral piece to separate into the shroud piece and the outer-circumferential annular piece.

4. A method for manufacturing the compressor housing for a turbocharger according to claim 2, the method comprising:

forming the scroll piece and an integral piece by die-casting, the integral piece integrally including a portion that is to be the shroud piece and a portion that is to be the outer-circumferential annular piece;

press-fitting the shroud press-fit part that constitutes part of the integral piece into the intake port of the scroll piece, and press-fitting the outer-circumferential annular press-fit part that constitutes part of the integral piece into the scroll outer-circumferential part of the scroll piece; and after the press-fitting steps, cutting the integral piece to separate into the shroud piece and the outer-circumferential annular piece.

5. The method for manufacturing the compressor housing for a turbocharger according to claim 3, wherein in the press-fitting steps, a shrink range between the scroll outer-circumferential part of the scroll piece and the outer-circumferential annular press-fit part that constitutes part of the integral piece is set smaller than a shrink range between the intake port of the scroll piece and the shroud press-fit part that constitutes part of the integral piece.

6. The method for manufacturing the compressor housing for a turbocharger according to claim 4, wherein in the press-fitting steps, a shrink range between the scroll outer-circumferential part of the scroll piece and the outer-circumferential annular press-fit part that constitutes part of the integral piece is set smaller than a shrink range between the intake port of the scroll piece and the shroud press-fit part that constitutes part of the integral piece.

7. The method for manufacturing the compressor housing for a turbocharger according to claim 5, wherein in the press-fitting steps, the shrink range between the scroll outer-circumferential part of the scroll piece and the outer-circumferential annular press-fit part that constitutes part of the integral piece is set to an extent to allow the outer-circumferential annular piece to be removed after the cutting step, and the method further comprises:

after the cutting step, detaching the outer-circumferential annular piece and removing cutting oil from the scroll piece and the outer-circumferential annular piece; and after the detaching and removing step, press-fitting again the outer-circumferential annular piece into the scroll piece with a seal member interposed between the scroll piece and the outer-circumferential annular piece.

8. The method for manufacturing the compressor housing for a turbocharger according to claim 6, wherein in the press-fitting steps, the shrink range between the scroll outer-circumferential part of the scroll piece and the outer-circumferential annular press-fit part that constitutes part of the integral piece is set to an extent to allow the outer-circumferential annular piece to be removed after the cutting step, and the method further comprises:

after the cutting step, detaching the outer-circumferential annular piece and removing cutting oil from the scroll piece and the outer-circumferential annular piece; and after the detaching and removing step, press-fitting again the outer-circumferential annular piece into the scroll piece with a seal member interposed between the scroll piece and the outer-circumferential annular piece.

9. The compressor housing for a turbocharger according to claim 1, wherein the outer-circumferential annular press-fit part includes a flange protruding in an outer-circumferential direction of the outer-circumferential annular press-fit part, a surface of the flange on an intake side being in contact with an outer-circumferential end surface that is an end surface of the scroll outer-circumferential part on a side opposite to the intake side, the surface of the flange and the end surface of the scroll outer-circumferential part extending parallel to each other.

* * * * *